US007400261B2

(12) United States Patent
Watanabe et al.

(10) Patent No.: US 7,400,261 B2
(45) Date of Patent: Jul. 15, 2008

(54) DISPLAY DEVICE, AND VEHICLE-MOUNTED DISPLAY DEVICE AND ELECTRONIC

(75) Inventors: Yasuko Watanabe, Kanagawa (JP); Yuko Tachimura, Kanagawa (JP)

(73) Assignee: Semiconductor Energy Laboratory Co., Ltd., Kanagawa-ken (JP)

( * ) Notice: Subject to any disclaimer, the term of this patent is extended or adjusted under 35 U.S.C. 154(b) by 544 days.

(21) Appl. No.: 10/820,810

(22) Filed: Apr. 9, 2004

(65) Prior Publication Data

US 2004/0201548 A1 Oct. 14, 2004

(30) Foreign Application Priority Data

Apr. 11, 2003 (JP) ..... 2003-107442

(51) Int. Cl.
*G08B 5/00* (2006.01)

(52) U.S. Cl. ..... 340/815.4; 340/815.45; 340/815.52; 340/815.55; 345/77; 345/87; 345/205; 349/152

(58) Field of Classification Search ..... 340/815.4, 340/815.45, 815.49, 815.52, 815.55, 438; 345/77, 76, 87, 204, 205; 349/151, 152, 349/149

See application file for complete search history.

(56) References Cited

U.S. PATENT DOCUMENTS

| | | | | |
|---|---|---|---|---|
| 5,064,275 | A * | 11/1991 | Tsunoda et al. | 349/24 |
| 5,631,638 | A * | 5/1997 | Kaspar et al. | 340/902 |
| 6,636,185 | B1 * | 10/2003 | Spitzer et al. | 345/8 |
| 6,737,800 | B1 | 5/2004 | Winters | |
| 7,061,555 | B2 * | 6/2006 | Wu et al. | 349/48 |
| 7,075,501 | B1 * | 7/2006 | Spitzer et al. | 345/8 |
| 7,088,417 | B2 * | 8/2006 | Kamijima et al. | 349/152 |
| 7,169,482 | B2 * | 1/2007 | Aziz et al. | 428/690 |
| 2002/0080018 | A1 | 6/2002 | Yamazaki | |

FOREIGN PATENT DOCUMENTS

| | | |
|---|---|---|
| JP | 2002-200936 | 7/2002 |
| JP | 3408154 | 3/2003 |

OTHER PUBLICATIONS

Exhibition of Active Matrix Type Organic EL Display at "13th Flat Panel Display Manufacturing Technology Expo & Conference" by ELDis Group (*in Japanese with full translation*); Jul. 2, 2003.

Documents distributed in the "13th Flat Panel Display Manufacturing Technology Expo & Conference" by ELDis Group (5 pages), Jul. 2, 2003.

"Two-way display developed"; *The Japan Times*; (1 page); Jul. 3, 2003.

"Mass Production of Organic EL Devices"; *Shimotsuke Newspaper (in Japanese with full translation)*; Jul. 3, 2003.

* cited by examiner

*Primary Examiner*—Davetta W. Goins
(74) *Attorney, Agent, or Firm*—Fish & Richardson P.C.

(57) ABSTRACT

To provide a display device, a vehicle-mounted display device, and an electronic device whose chassis are not large with much design freedom. In the present invention, a plurality of light-emitting elements each having a luminescent material sandwiched between a pair of electrodes having transparency, a plurality of liquid crystal elements each having a liquid crystal material sandwiched between a pair of electrodes having transparency are arranged in a display device over a substrate having a mirror surface. Further, a plurality of light-emitting elements each having a luminescent material sandwiched between a pair of electrodes having transparency, a plurality of liquid crystal elements each having a liquid crystal material sandwiched between a pair of electrodes having transparency are arranged in a display device over a substrate having a reflecting surface. The display device is secured to the substrate with a barrier film therebetween.

22 Claims, 7 Drawing Sheets

DISPLAY DEVICE, AND VEHICLE-MOUNTED DISPLAY DEVICE AND ELECTRONIC

BACKGROUND OF THE INVENTION

1. Field of the Invention

The present invention relates to a display device that includes a display element having a transparent electrode. Further, the invention relates to a vehicle used for transport of people or goods and to an electronic device with the use of the display element of the present invention. Still further, the invention relates to a vehicle-mounted display device.

2. Description of the Related Art

There is a technique in which sight to be reflected in a side-view mirror or a rearview mirror provided for a vehicle is increased by applying a display device to the mirror (Reference 1: Japanese Patent Laid-Open No. 2002-200936 (FIGS. 4, 5, 16, and 17)). In Reference 1, the following structures are disclosed: the first structure in which a display device itself which is provided on a side-view mirror or the like is used as a mirror, the second structure in which reflection of display is seen in a half mirror or the like, and the third structure in which a mirror and a display device are provided in parallel.

In the first structure in the above reference, since it is preferable to fabricate a display screen is shaped like a rectangle, a mirror using the display device should also be shaped like a rectangle. Accordingly, the design freedom is limited. In the second structure, the thickness of a chassis is increased. Meanwhile, the longitudinal length of a chassis is increased in the third structure.

BRIEF SUMMARY OF THE INVENTION

Considering the above facts, it is an object of the present invention to provide a display device whose chassis is not large with much design freedom. It is another object of the invention to provide a vehicle-mounted display device and an electronic device using the above display device.

Further, the following measures are taken in the invention to solve the problems of the related art.

One feature of the present invention is that a plurality of light-emitting elements each having a luminescent material sandwiched between a pair of electrodes having transparency, or a plurality of liquid crystal elements each having a liquid crystal material sandwiched between a pair of electrodes having transparency are arranged in a display device over a substrate having a mirror surface.

One feature of the present invention is that a plurality of light-emitting elements each having a luminescent material sandwiched between a pair of electrodes having transparency, or a plurality of liquid crystal elements each having a liquid crystal material sandwiched between a pair of electrodes having transparency are arranged in a display device over a substrate having a reflecting surface. The display device is secured to the substrate with a barrier film therebetween.

The substrate having a mirror surface or a reflecting surface is equivalent to a mirror. Such a substrate is obtained by applying a silver nitrate solution onto a first substrate (a glass substrate), coating the substrate with a colloidal silver thin film (a reflection coating) by using caustic soda or the like, and applying a protective film such as a resin film thereover.

A pair of electrodes forming a display element such as a light-emitting element or a liquid crystal element have transparency; thus, the display device becomes transparent when no image is displayed. In other words, the invention provides a structure in which a mirror is provided with a display element, and two functions of a mirror function and a display function to display an image are enabled. In that case, a mirror and a display element can be directly stacked together. Alternatively, a display element can be transferred onto a mirror with a barrier film therebetween by employing a peeling method.

Further, the display device has an image sensing device in which a plurality of photovoltaic conversion elements are arranged. In this case, the light-emitting element has two functions of displaying an image and serving as a light source while information of a subject is read. Moreover, the display device has three functions in total including the image sensing function to read information of a subject in addition to the mirror function and the display function to display an image.

The mirror surface or the reflecting surface, and the display area are not required to have the same shape in the above structure. For example, the mirror surface or the reflecting surface may have a rectangular shape, and the display area may have a trapezoidal shape. Accordingly, design freedom of the display device itself is increased. Further, the chassis would not be large. In general, the state where a display element is sealed is called as a module, and the state where an IC such as a controller is mounted on such a panel is called as a module. A display device here includes a panel and a module.

Further, the invention provides a vehicle which is equipped with a display device serving as a side-view mirror or a rearview mirror. In this case, the mirror function can be used mainly and the display function may be used when necessary. Thus, a vehicle which is highly sophisticated and highly value added can be provided. By installing a camera or a sensor measuring the distance between the cars in a vehicle, a driver can drive more comfortably and safely by acquiring the information as necessary.

Further, the invention provides a vehicle-mounted display device using the display device for a side-view mirror or a rearview mirror.

The invention further provides an electronic device using the above display device. In this case, the display function can be used mainly, and the function of a mirror may be used when necessary. Thus, an electronic device with more sophistication and higher added value can be provided.

As for the display device according to the present invention, a first electrode and a second electrode each use a transparent material. Accordingly, using the characteristics of the display element being transparent when no image is displayed, a display device that collectively has two functions of the mirror function using a reflection coating and the display function to display an image by using a display element can be provided.

The invention further provides a vehicle including the above display device as a side-view mirror or a rearview mirror. In this case, the mirror function can be used mainly and a display function may be used when necessary. Thus, a vehicle which is highly sophisticated and highly value added can be provided. By installing a camera or a sensor measuring the distance between the cars in a vehicle, a driver can drive more comfortably and safely by acquiring the information as necessary.

The invention further provides an electronic device with the use of the display device. In this case, the display function can be used mainly, and the function of a mirror may be used when necessary. Thus, an electronic device with more sophistication and higher added value can be provided.

DETAILED DESCRIPTION OF THE INVENTION

Figure 1A:
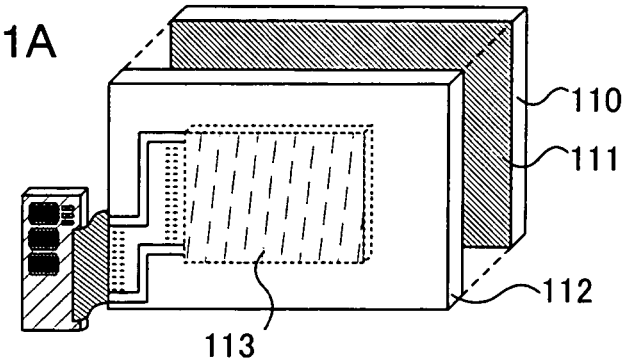
FIGS. 1A to 1E are diagrams showing a display device according to the present invention (Embodiment Mode 1).

Embodiment modes of the present invention will be described in detail by using the accompanying drawings. Note that the invention is not limited to the following description, and those skilled in the art can easily understand that the mode and details can be variously changed without departing from the spirit and scope of the invention. Accordingly, the invention is not to be interpreted with limitation to the content of the following embodiments and embodiment modes. Incidentally, in the structure according to the present invention, the reference numerals denoting the same parts are commonly used in the different drawings.

EMBODIMENT MODE 1

A display device of the present invention will be described with reference to FIGS. 1A to 1E. A display device of the present invention has substrates 110 and 112, a reflection coating 111, and a display area 113. As is shown, the structure of a display device of the invention is roughly divided into two types, one is a structure in which the substrate 110 having the reflection coating 111 and the substrate 112 having the display area 113 are stacked together (FIG. 1A). Note that the expression "stacked together" includes a state where the substrate 110 and the substrate 112 are stuck together with no space therebetween, with a transparent material such as resin provided therebetween, with gas such as an inert gas supplied into the space, or the like. In this structure, a plurality of substrates; at least one of them is provided with the reflection coating 111 and the another at least one of them provided with the display area 113 are used.

Figure 1B:
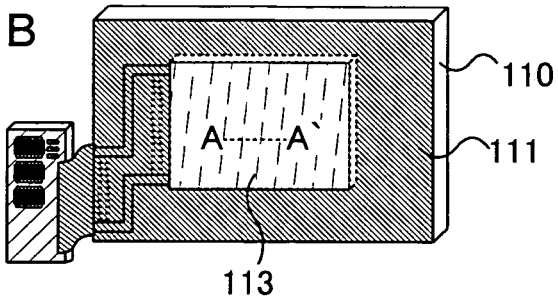

Another is a structure in which the reflection coating 111 is provided on the substrate 110, and the display area 113 is provided on the reflection coating 111 (FIG. 1B). This structure is obtained by stacking display elements forming the reflection coating and the display area, or by formation using techniques of peeling and transfer.

In each structure above, a light-emitting element or a liquid crystal element can be given as the display element forming the display area 113, and the element is equivalent to a layered product including a layer containing a luminescent material or a layer containing a liquid crystal material between a first electrode (anode) and a second electrode (cathode). In the invention, a light-transmitting material is used for the first and the second electrodes of the display element. Accordingly, using the characteristics of the display element being transparent when no image is displayed, a display device that collectively has two functions of the mirror function using the reflection coating 111 and the display function to display an image by using a display element can be provided.

The light-emitting element has a structure in which a luminescent material is interposed between a pair of electrodes. The light-emitting element is constituted by a wide variety of materials such as an organic material, an inorganic material, a thin film material, a bulk material, a dispersion material, or the like. The luminescence of a luminescent material is produced when a singlet excited state returns back to a ground state (fluorescent light) or when a triplet excited state returns to a ground state (phosphorescent light). Either or both types of the luminescence can be used here.

In the structure shown, the substrates 110 and 112, and the display area 113 have the same shape of a rectangle; however, the invention is not limited thereto. For example, the substrate 112 may be shaped a rectangle, and the display area 113 may have a square shape. Further, in the structure shown, the display area 113 is formed only in the central part of the substrate 112; however, the invention is not limited thereto, and the display area 113 may be formed over the entire surface of the substrate 112.

Figure 1C:
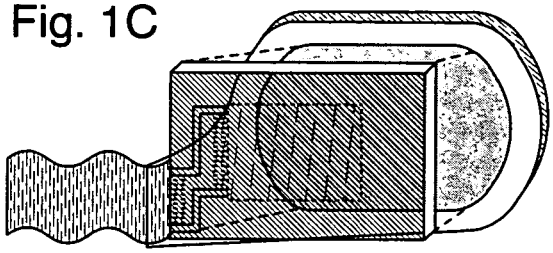
Figure 1D:
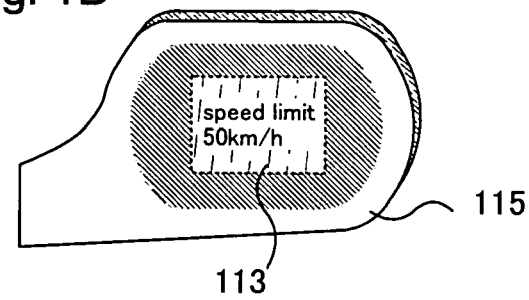
Figure 1E:
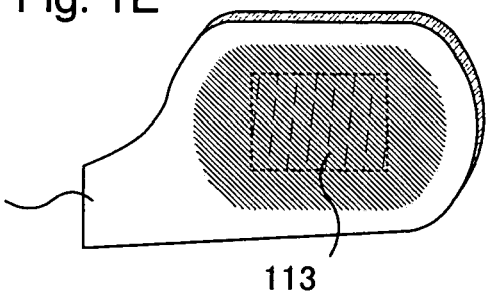

The case of applying a display device having the structure shown in FIG. 1B to a side-view mirror of a vehicle is shown in FIGS. 1C to 1E. In FIG. 1C, the display device is built into a chassis 115. When the display device is used for a side-view mirror, it may be mainly used as a mirror (FIG. 1E), and the display function may be used when some information is required (FIG. 1D).

Figure 2A:
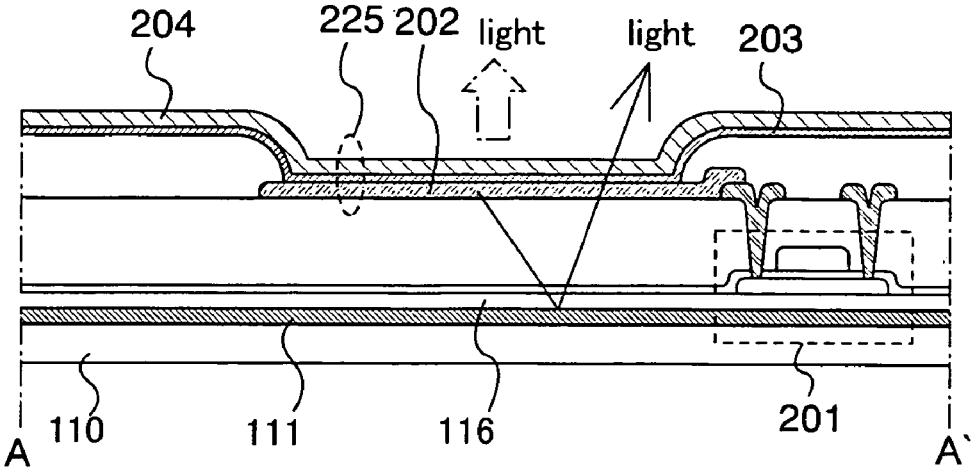
FIGS. 2A to 2C are diagrams showing a display device according to the invention (Embodiment Mode 1).
Figure 2B:
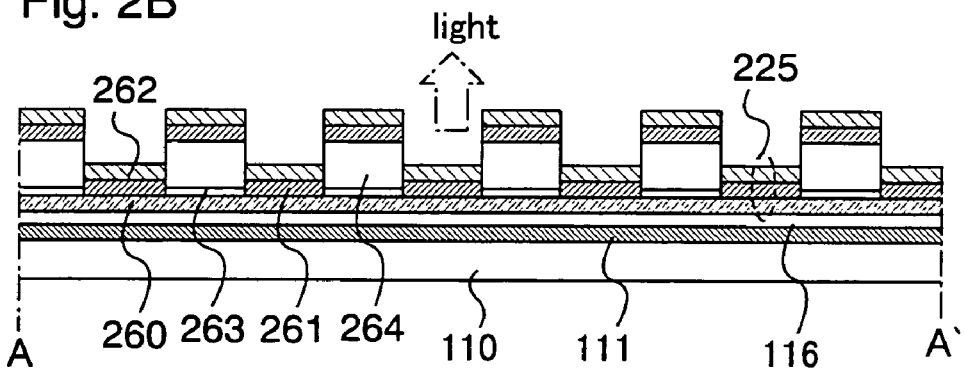
Figure 2C:
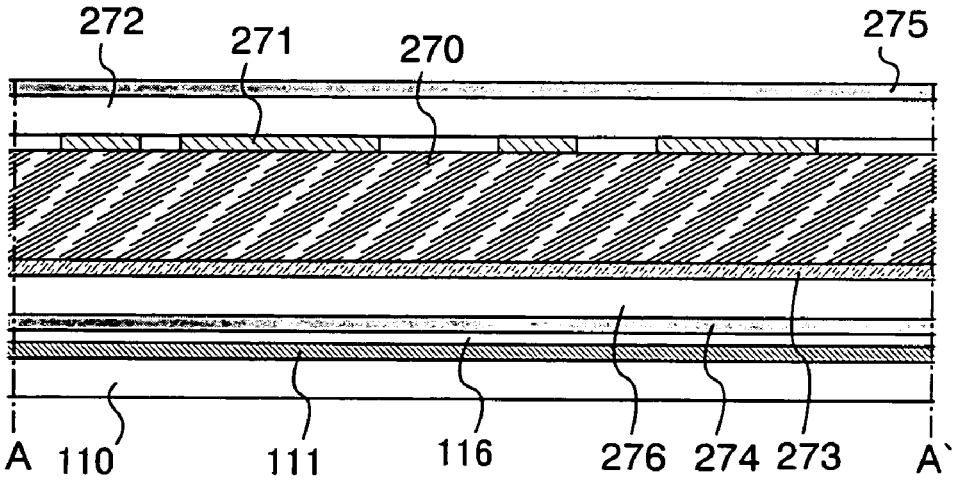

Next, the detailed structure of a display device of the present invention will be described with reference to FIGS. 2A to 2C. Here, the display device shown in FIG. 1B will be described with reference to a cross-section taken along line A-A' (FIGS. 2A to 2C).

First, a display device of an active type using a transistor will be described with reference to FIG. 2A. In FIG. 2A, a reflection coating 111 is provided over a substrate 110 having light-transmittivity and an insulating film (a barrier film) 116 is provided over the reflection coating 111. Further, a driver transistor 201, a first electrode (a pixel electrode) 202, a layer containing a luminescent material 203, and a second electrode (a counter electrode) 204 are provided over the insulating film 116. A layered product of the first electrode 202, the layer containing a luminescent material 203, and the second electrode 204 is equivalent to a light-emitting element 225.

Subsequently, a display device of a passive type will be described with reference to FIG. 2B. In FIG. 2B, a reflection coating 111 is provided over a substrate 110 having light-transmittivity, and an insulating film (a barrier film) 116 is provided over the reflection coating 111. Further, a first electrode (a pixel electrode) 260, a layer containing a luminescent material 261, and a second electrode (a counter electrode) 262 are provided over the insulating film 116. A layered product of the first electrode 260, the layer containing a luminescent material 261, and the second electrode 262 is equivalent to a light-emitting element 225. Besides, an insulating film 263 serving as a bank and a resin film 264 are provided. Note that a material based on an inorganic material may be used for the layer containing the luminescent material 261, and in that case, an insulating layer may be provided between the first electrode 260 and the layer containing the luminescent material 261 or between the second electrode 262 and the layer containing the luminescent material 261. A structure in which aluminum oxide ($Al_2O_3$) and titanium oxide ($TiO_2$) are alternately stacked together by thermal CVD using adsorption reaction of the deposition surface may be used for the insulating layer.

Subsequently, a display device using a liquid crystal element (a segment type is shown here) rather than a light-emitting element as a display element will be described with reference to FIG. 2C. In FIG. 2C, a reflection coating 111 is provided over a substrate 110, and an insulating film (a barrier film) 116 is provided over the reflection coating 111. Further, a substrate 272 in which a second electrode 271 is formed and a substrate 276 in which a first electrode 273 is formed can be stuck together with a sealant or the like, and a liquid crystal layer 270 can be provided by vacuum injection. Note that both the substrates 272 and 276 have light-transmittivity and are respectively provided with an alignment layer 274 and an alignment layer 275.

In the display device, the first electrode 202 and the second electrode 204 in the structure of FIG. 2A, the first electrode 260 and the second electrode 262 in the structure of FIG. 2B, and the first electrode 273 and the second electrode 271 in the structure of FIG. 2C are formed from a material having light-transmittivity. Since the display element is transparent when the display device dose not display anything, a display device having two functions of a mirror function and a display function to display an image can be provided.

As shown in FIGS. 2A and 2B, a light-emitting element 225 emits light in a first direction toward the substrate 110 and in a second direction opposite to the first direction. However, the light emitted in the first direction is reflected by the reflection coating 111, and directed toward the second direction. Accordingly, it is preferred to provide the reflection coating 111 in a lower layer, thereby improving the transmittance of the light given off from the light-emitting element 225. Note that the material having light-transmittivity denotes a transparent conductive film such as an ITO film or a conductive film such as an aluminum film, which is formed to have a certain thickness thereby transmitting light.

Subsequently, unlike in the above case, a display device further having an image sensing function will be described with reference to FIG. 3.

Figure 3A:
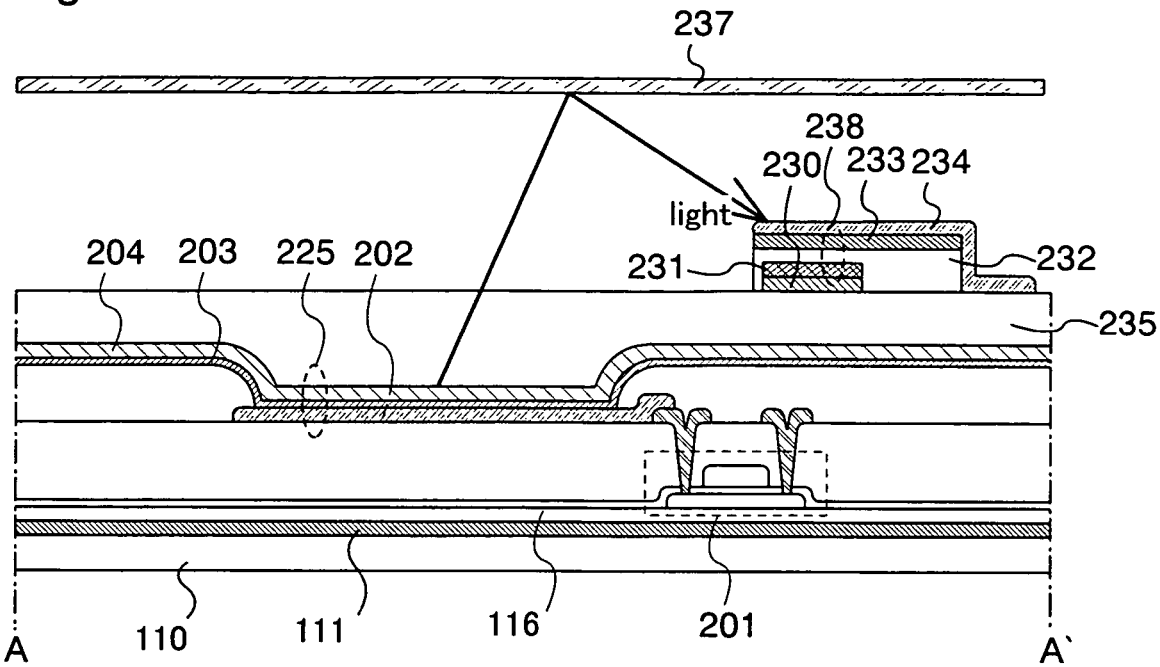
FIGS. 3A and 3B are diagrams showing a display device according to the invention (Embodiment Mode 1).

In FIG. 3A, the driver transistor 201 and a light-emitting element 225 are provided over a substrate 110 having transparency as in the structure shown in FIG. 2A. In this structure, a photovoltaic conversion element 238 including a layered product of a p-layer 231, an i-layer (an intrinsic layer) 232, and an n-layer 233; an electrode 230 connected to the p-layer 231; and an electrode 234 connected to the n-layer 233 are provided over an insulating film 235 formed over a second electrode 204.

A display device having the above structure uses the light-emitting element 225 as a light source, and the photovoltaic conversion element 238 as an image sensing element. Both the light-emitting element 225 and the photovoltaic conversion element 238 are disposed over a one substrate 110. The light emitted from the light-emitting element 225 reflects in a subject 237, and the reflected light enters the photovoltaic conversion element 238. The potential difference between both electrodes of the photovoltaic conversion element 238 changes and a current flows between the both electrodes in response to the changed potential difference. The information of the subject 237 can be acquired by detecting the amount of the current. Further, the acquired information can be displayed by using the light-emitting element 225.

In other words, the light-emitting element has two functions of displaying an image and serving as a light source while information of a subject is read. In addition, the display device has the three functions in total including the image sensing function to read information of a subject in addition to the mirror function and the display function to display an image. Despite the display device of this embodiment has three functions, a light source and a light scatterer which are usually required in the case of using an image sensing function are not required to be provided separately. Therefore, the display device can be made far smaller, thinner, and lighter with the use of the display device according to this embodiment mode.

Figure 3B:
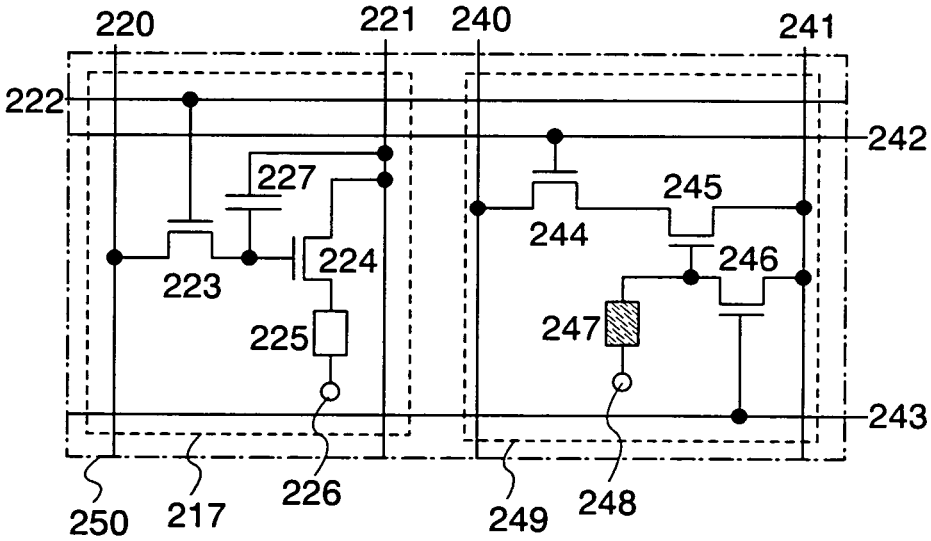

An example of an equivalent circuit of a display device having the structure will be described with reference to FIG. 3B. A pixel 250 is shown in FIG. 3B. The pixel 250 has a sub-pixel 217 including a light-emitting element 225, and a sub-pixel 249 having a photovoltaic conversion element 247. The sub-pixel 217 has a signal line 220, a power line 221, a scanning line 222, a switching transistor 223 controlling input of a video signal, a driver transistor 224 supplying a current in response to the input video signal to the light-emitting element 225, an electric source 226 and a capacitor 227. This sub-pixel 217 can take a structure of a typical equivalent circuit as shown in a cross section of a transistor and a light-emitting element in FIG. 2A. Further, the sub-pixel 249 has a signal line 240, a power line 241, a scanning line 242, a scanning line 243, a resetting transistor 246 resetting a potential difference between both electrodes of the photovoltaic conversion element 247, an amplifying transistor 245 in which the amount of a current flowing between a source and a drain thereof is determined in response to the potential difference between both the electrodes of the photovoltaic conversion element 247, and a switching transistor 244 controlling input of a signal read from the photovoltaic conversion element 247 to a driver circuit.

Note that, in FIG. 3, the case wherein a light-emitting element and a photovoltaic conversion element are provided on one substrate is illustrated; however, a passive light-emitting element illustrated in FIG. 2B and a photovoltaic conversion element may be provided on one substrate. Further, shown above is the case in which one pixel has the light-emitting element 225 and the photovoltaic conversion element 238 is illustrated; however, every pixel is not necessarily provided with the photovoltaic conversion element 238, and the photovoltaic conversion element 238 may be provided for a group of pixels in accordance with a subject to read and the usage. Thus, the aperture ratio of the light-emitting element 225 increases, and a bright image can be provided in the case of using a display function.

The display device described with reference to FIGS. 2A to 3C have a structure in which the reflection coating 111 is formed over the substrate 110 and a display element is laminated thereover; however, the invention is not limited thereto, and the display device may be obtained by transfer using a peeling method. The method will be described below.

First, the driver transistor 201 and a light-emitting element 225 are formed over a first substrate of a quartz or glass substrate so that the display device has the same cross sectional structure as above the insulating film 116. An insulating film is formed on the formed light-emitting element 225; an adhesive is formed on the insulating film; a two-sided tape is pasted on the adhesive; and the second substrate is pasted on the two-sided tape. Thereafter, the first substrate is peeled by physical means, so that a base film formed under the driver transistor 201 is exposed. Subsequently, an adhesive is formed over the exposed base film, and an adhesive is pasted to a third substrate. Finally, the second substrate is peeled so that the driver transistor 201 and the light-emitting element 225 can be formed over the third substrate. In this case, a substrate vulnerable to heat such as a plastic substrate can be used as the third substrate. When a panel using a plastic substrate having flexibility is used, the use of the display device will be expanded remarkably. It is very advantageous to use a plastic substrate for a portable electronic device, a vehicle, or the like due to its lightweight.

In this embodiment mode, an example of using a thin film transistor (TFT) of a crystalline semiconductor for a switching element or a driving element is given; however, the invention is not particularly limited thereto. For example, a thin film transistor of an amorphous semiconductor, a MOS transistor, an organic transistor, a single-molecule transistor, or the like can also be used similarly.

EMBODIMENT MODE 2

This embodiment mode will be described with reference to FIGS. 4A to 5C.

Figure 4A:
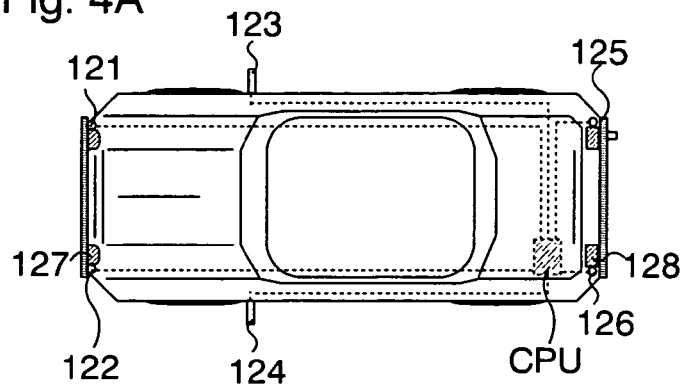
FIGS. 4A to 4C are diagrams showing a vehicle according to the invention (Embodiment Mode 2).
Figure 4B:
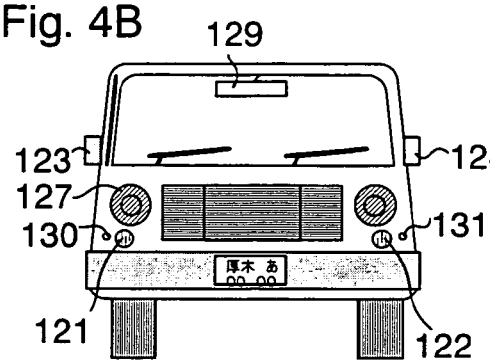
Figure 4C:
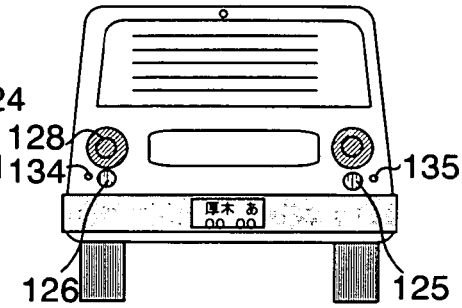

FIG. 4A is a top view of a vehicle. FIG. 4B is a side view of the vehicle viewed from the front. FIG. 4C is a side view of the vehicle viewed from the back. In FIGS. 4A to 4C, the vehicle has cameras 121, 122, 125, and 126, side-view mirrors 123 and 124, lights 127 and 128, a rearview mirror 129, and sensors 130, 131, 134, and 135. Further, it is not illustrated; however, the vehicle is equipped with an energy source such as electricity or gasoline, a motor such as an engine, a power transmission device, a braking device, a steering system, a suspension system, auxiliaries, and accessories. Note that the number and the position of a camera, a sensor, and a microphone can be determined arbitrarily without limitation to the illustrated case.

It is preferable to use a camera equipped with a fisheye lens for the cameras 121, 122, 125, and, 126; thus, 360 degrees in all directions can be photographed. The camera may be anything that can take an image, for example, a CCD camera may be used. As for the sensors 130, 131, 134 and 135, a distance sensor measuring distance between the cars, an impact sensor detecting abnormality of the body, or the like may be installed.

As another example of the vehicle manufactured using the invention, a car such as a sports car, a truck, a bus, a station wagon, a motor vehicle for special purpose (such as an ambulance), a special kind car (such as a tractor), and a motor vehicle with special body (such as a tanker); a train; and a motorbike are given other than the car illustrated in FIGS. 4A to 4C. Examples thereof are shown FIGS. 5A to 5C.

Figure 5A:
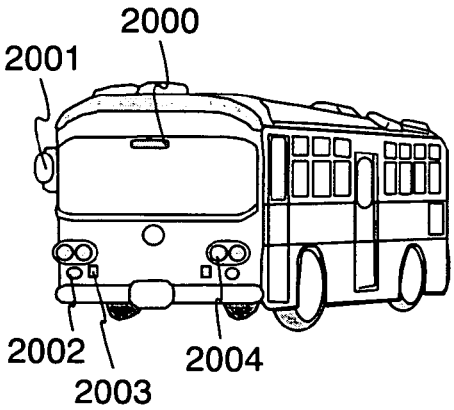
FIGS. 5A to 5C are diagrams showing a vehicle according to the invention (Embodiment Mode 2).
Figure 5B:
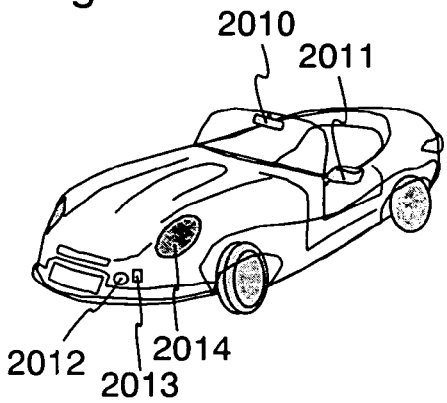
Figure 5C:
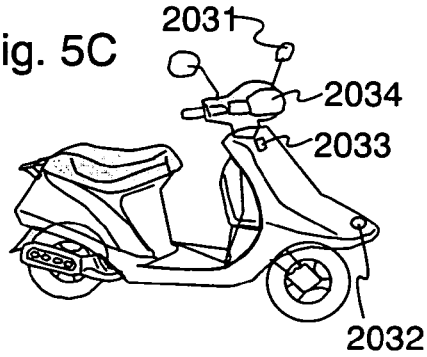

FIG. 5A shows a bus aimed for the transportation of many people, which includes: a side-view mirror 2001, a rearview mirror 2000, a camera 2002, a sensor 2003, and a light 2004. FIG. 5B shows a sports car including: a rearview mirror 2010, a side-view mirror 2011, a camera 2012, a sensor 2013, and a light 2014. FIG. 5C shows a motorcycle including: a side-view mirror 2031, a camera 2032, a sensor 2033, and a light 2034.

Each of the vehicles given above is provided with a side-view mirror and a rearview mirror. A side-view mirror is mounted on either side of the body; the mirror that mainly provides a view of what is behind. The side-view mirror is called a side mirror. A rearview mirror is installed inside the body; the mirror mainly provides a view of what is behind. The rearview mirror is called a driving mirror. Display devices according to the invention can be used for the mirrors. Since a display device of the invention has and two functions of a mirror function and a display function to display an image. The mirror function may be mainly used and the display function can be used as necessary with one touch operation. Thus, an electronic device with more sophistication and higher added value can be provided. Further, when the display function is used, a sensor or a camera is provided for the display, and the obtained information can be displayed. Still further, the display device may be provided with a transceiver circuit, and thus, access to the Internet can be obtained and the required information can be displayed. Further, by using a speaker inside the vehicle, a driver can be warned of danger of the vehicle both with the display function and by voice. A CPU may be provided inside the vehicle all elements, and may be connected to the CPU thereby operating the system. Thus, the driver can drive more comfortably and safely by acquiring a variety of information.

The luminescent material is suitable for use in a car since it can endure under harsh environment from below the freezing point of −40° C. to high-temperature over 100° C. Further, the luminescent material does not cause environmental pollution since it is made of an organic material.

The invention can be applied to all the mirrors mounted on a vehicle without limitation to a side-view mirror and a rearview mirror. Further, this embodiment mode can be freely combined with Embodiment Mode 1.

EMBODIMENT MODE 3

As an example of electronic devices manufactured according to the present invention, a digital camera, a sound reproduction apparatus such as a car audio, a note book type personal computer, a game machine, a portable information terminal (a cellular phone, a portable game machine, and the like), and an image reproduction device equipped with a recording medium such as a home video game machine can be noted. The specific examples thereof are described with reference to FIGS. 6A to 6C.

Figure 6A:
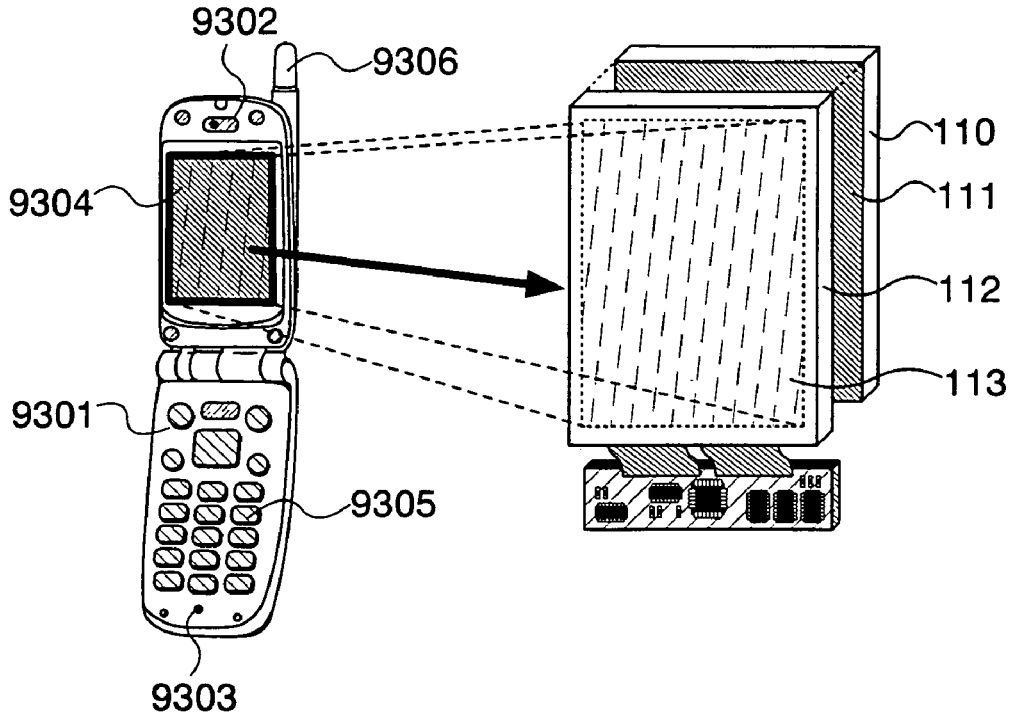
FIGS. 6A to 6C are diagrams showing electronic devices according to the invention (Embodiment Mode 3).

FIG. 6A is a portable terminal, which includes a body 9301, a voice output portion 9302, a voice input portion 9303, a display area 9304, an operation switch 9305, an antenna 9306, and the like. When a light-emitting device of a self luminous type is used as a display element provided for the display area 9304, since a back-light and the like is not needed, thin, small and light display area can be obtained as compared with the case of using a liquid crystal element, thereby being extremely effective for the portable terminal as shown.

Figure 6B:
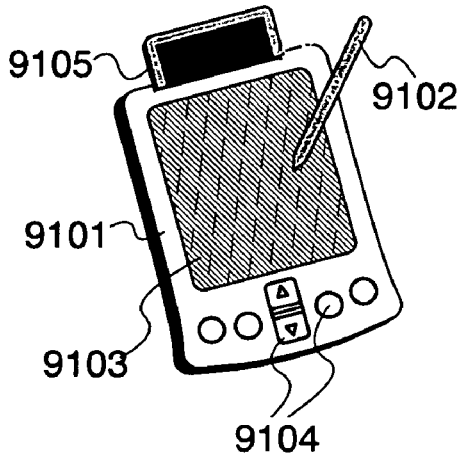
Figure 6C:
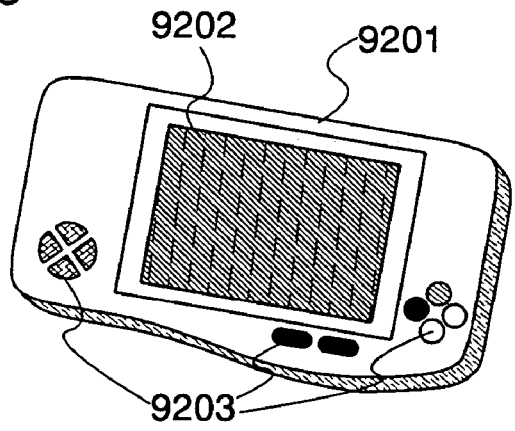

FIG. 6B is a PDA (personal digital assistant), which includes a body 9101, a stylus 9102, a display area 9103, an operation switch 9104, and an external interface 9105 and the like. FIG. 6C is a portable game machine, which includes a body 9201, a display area 9202, an operation switch 9203, and the like.

A display device according to the present invention can be used for the display device including display areas 9304, 9103, and 9202 in the electric apparatuses described above. As described above, the display device according to the present invention has two functions of a mirror function and a display function to display an image. When the invention is applied to the above PDA, the display function can be mainly used and the mirror function may be used as necessary with one touch operation. Thus, an electronic device with more sophistication and higher added value can be provided.

This embodiment mode can be freely combined with the above embodiment modes.

EMBODIMENT 1

In this embodiment, components of a vehicle of the present invention and relations among the components thereof will be described with reference to a block diagram shown in FIG. 7.

Basic components include a display device 324, a speaker 322 mounted inside of the vehicle, a microphone 321 which is attached to the body, a distance sensor 325 measuring distance between the cars and a shock, and a camera 305 having a shooting function.

Figure 7:
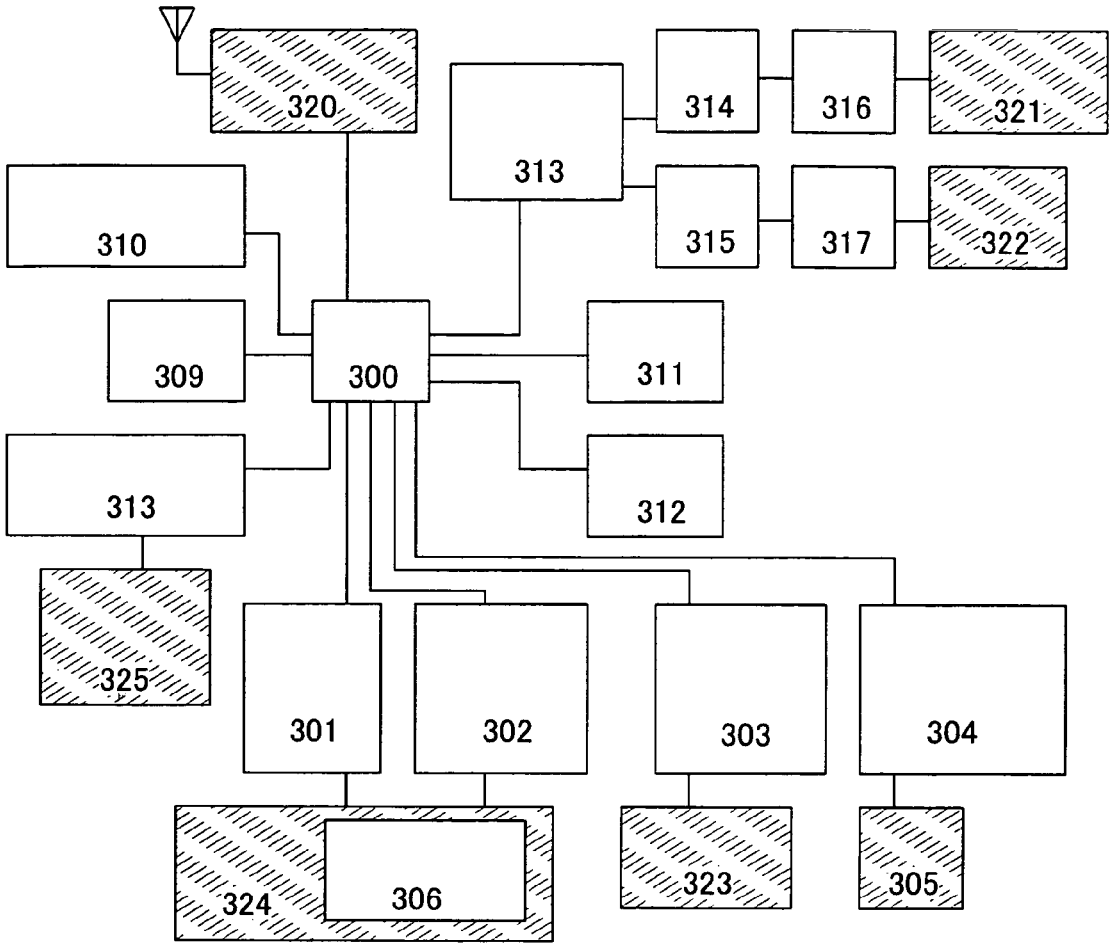
FIG. 7 is a diagram showing a system according to the invention (Embodiment 1).

As shown in FIG. 7, the display device 324 may include an image sensor 306. The display device can be controlled by a controller 301, and the image sensor can be controlled by a sensor controller 302. Further, an operation button 323 is controlled by a button controller 303, and the camera 305 is controlled by a camera controller 304. The controllers are concentrated and managed by a CPU 300. Further, the CPU 300 is connected to a storage medium such as a flash memory 310, a DRAM 311 and a VRAM 312, an external interface 309, or the like.

When a user operates the operation button 323, information is displayed on the display device 324 via the button controller 303, the CPU 300, and the controller 301. Similarly, when a user operates the image sensor 306, information is displayed on the display device 324 via the sensor controller 302, the CPU 300, and the controller 301.

The speaker 322 that is to be a microphone amplifier by which a user hears the ambient sound receives information on the circumstances from a microphone 321. Thereafter, the information is sent to a data-processing circuit 313 via an amplifier 316 and an AID converter circuit 314. Then, the information is converted into an analog signal by a D/A converter circuit 315; the converted analog signal is amplified by an amplifier 317; and the signal finally reaches the speaker 322.

The information supplied from the distance sensor 325 measuring distance between the cars and a shock is first provided for the data-processing circuit 313, and the information is thereafter displayed on the display device 324 via the CPU 300 and the controller 301. As the sensors, well-known sensors may be used. Further, the camera 305 having a shooting function is controlled with the camera controller 304, and the camera controller is managed by the CPU 300. An image shot with the camera 305 is stored in a storage medium such as a flash memory 310, and is displayed on the display device 324 via CPU 300 according to the operation of the operation button 323 by a user.

It is preferable to interlock the distance sensor 325 and the camera 305 with a voice function and a display function thereby providing an alarm function for more comfortable and safe driving. For example, the information provided from the distance sensor 325 may be displayed on the display device 324 and may further be provided by the speaker 322 thereby warning a driver of danger.

Note that the illustrated components of a vehicle are only examples, and other components may be included. Further, this embodiment can be freely combined with the above embodiment modes.

EMBODIMENT 2

In this embodiment, a system used for an electronic device or a vehicle will be described with reference to the drawings.

The sensor measuring distance between the cars and a shock of the body has already been mentioned as a component of a vehicle. The structure of a distance sensor will be briefly described with reference to FIG. 8A in this embodiment.

The distance sensor has a function to measure distance from the vehicles around, and one or more distance sensor may be mounted on one or several parts of the body. An operation button of the sensor can be provided near a driver's seat and the sensor can be used by operating the button. Further, the sensor can be made to measure the distance at regular time intervals.

Figure 8A:
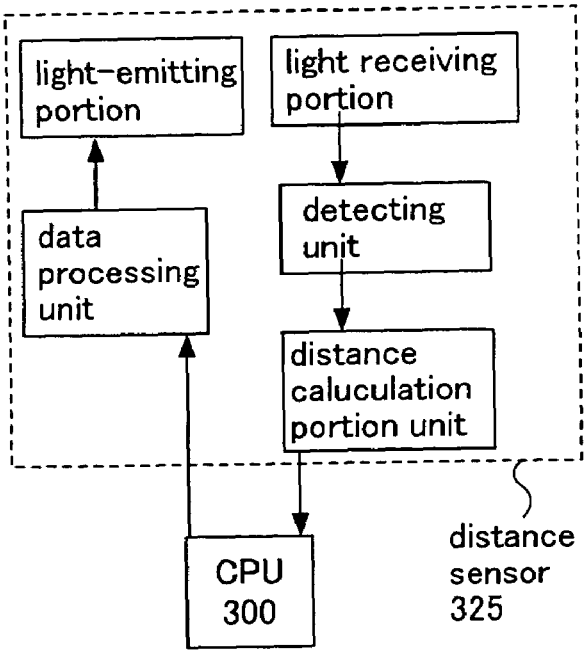
FIGS. 8A and 8B are diagrams showing a distance sensor and a system mounted on a vehicle according to the invention.

An example of a structure of the distance sensor is shown in FIG. 8A. A light-emitting portion, a light receiving portion, a data processing unit, and a detecting unit and a distance calculation unit are included. The light-emitting portion includes a laser, and the laser beam is emitted in synchronization with a signal output from the data processing unit. Meanwhile, the light receiving portion receives a laser beam reflected from another vehicle. The time from emission to reception of the laser beam is detected by the detecting unit, and the information is supplied to the distance calculation unit. Further, the distance from another vehicle is measured by the distance calculation unit. All components such as the data processing unit and the distance calculation unit in this sensor are controlled by the CPU 300, and display is performed by the display device via the CPU 300.

Figure 8B:
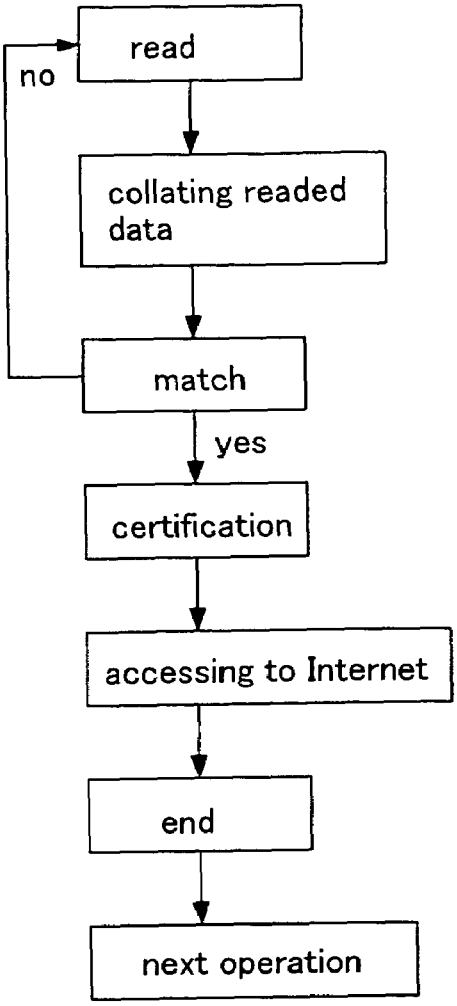

When a display device having the structure described with reference to FIG. 3 is applied, a display device or an electronic device, which has three functions in total including the image sensing function to read information of a subject in addition to the mirror function and the display function to display an image can be provided. In this embodiment, a personal identification system utilizing the reading function will be described with reference to the flowchart in FIG. 8B.

First, biological information of a person is read by using an image sensor 306 provided in a display device. Note that the biological information signifies the body feature that a human being has by nature; and yet, a person can be identified individually by the information. A fingerprint, a palm print, or the like can be given as typical biological information. Considering the size of the electronic device, it is preferable to read a fingerprint, particularly, a fingerprint of a thumb as the biological information. However, the invention is not limited thereto, and a palm print and a voiceprint that can be obtained with the use of a microphone 321 may be used as the biological information.

The obtained biological information is compared with biological information previously saved in a storage medium via a CPU 300. If the two pieces of the information match here, a user is certified as a right owner, and the user can successively perform a process (access to the internet here). Thereafter, the user can move on to the next step. Note that if the information does not match, the read operation should be redone.

As for the personal identification system shown in this embodiment, when it is used for a vehicle, it may be used as a key for opening the door. Further, when the personal identification system is used for an electronic device, it is preferably used before all processes that cause trouble when is operated by other people, such as fee-based information processing and rewriting process of a storage medium. Thus, an illegal process can be prevented.

This embodiment mode can be freely combined with the embodiment and the embodiment modes above.

EMBODIMENT 3

A substrate having a reflecting surface or a mirror surface which is indispensable component of the invention will be described below. The reflecting surface denotes a surface of a reflector, the surface roughness is not particularly limited. A mirror surface signifies a surface of a mirror; and its surface is ground and smooth. Accordingly, a substrate having a reflecting surface or a mirror surface has the property of reflecting an image of a thing using a reflection of light on the surface, and they have different surface roughness.

In the invention, a substrate itself having a reflecting surface or a mirror surface may be applied, or a substrate on which a thin film having a reflecting surface or a mirror surface may be used. The thin film having a reflecting surface or a mirror surface is equivalent to a thin film containing one or more of aluminum (Al), silver (Ag), gold (Au), copper (Cu), cadmium (Cd), nickel (Ni), platinum (Pt), rhodium (Rh), tungsten (W), titanium (Ti), tantalum (Ta), molybdenum (Mo), chrome (Cr), neodymium (Nd), iron (Fe), nickel (Ni), cobalt (Co), zirconium (Zr), zinc (Zn), ruthenium (Ru), palladium (Pd), osmium (Os), iridium (Ir), and tin (Sn); a film including an alloy material or a compound material containing one or more elements selected from the plurality of elements as the main component; or a thin film including a laminated film in which plural thin films selected from the above thin films are stacked together. Further, a protective film may be formed over the thin film having a reflecting surface or a mirror surface to hold the reflecting effect.

Further, the thin film having a reflecting surface or a mirror surface may be formed by any of vapor deposition, sputtering, vapor phase epitaxy (CVD), or plating. Spin coating may be employed in the case of applying a coloring material. Thus, a thin film having a uniform thickness can be formed. A droplet ejection method typified by screen printing or ink-jet printing may be used other than the above methods or techniques.

Then, subsequently, a structure of the light-emitting element which is a component of the present invention will be described. A light-emitting element is equivalent to a layered product of a conductive layer, an electroluminescent layer, and another conductive layer provided on one surface of a substrate having an insulating surface such as a glass substrate, a quartz substrate, a metal substrate, or an organic substrate. In the invention, the substrate to be provided with a light-emitting element has transparency. The light-emitting element may be a laminated type in which an electroluminescent layer has a plurality of layers, a single layer type having one electroluminescent layer, or a mixed type in which an electroluminescent layer has a plurality of layers but the borders thereof are ill-defined. The layered structure of the light-emitting element can take either of the following orders: one is an order in which a conductive layer equivalent to an anode/an electroluminescent layer/a conductive layer equivalent to a cathode are stacked from the bottom, and the other is the reverse order in which a conductive layer equivalent to a cathode/an electroluminescent layer/a conductive layer equivalent to an anode are stacked from the bottom. However, an appropriate structure should be selected in accordance with the application. Either of an organic material (with a low, intermediate, or high molecular weight), a material in which an organic material and an inorganic material are combined together, a singlet material, a triplet material, or a material which is a combination of the above materials may be used for the electroluminescent layer. Further, a structure in which light-emitting layers having different emission wavelength range are formed in every pixel of the electroluminescent layer may be employed thereby performing color display. Electroluminescent layers corresponding to the respective colors of R (red), G (green), and B (blue) are typically used. In that case, when a structure in which a filter (a colored layer) transmitting light of the emission wavelength range is provided on the emission side of a pixel is employed, improvements in color purity and prevention of reflection in a pixel area can be conducted. A circularly polarizing plate or the like which is conventionally required can be omitted by providing a filter (coloration layer), and thus, loss of light emitted from the light-emitting layer can be eliminated. Further, change in color tone that occurs when a pixel area (a display screen) is viewed from an angle can be reduced. Since such a light-emitting element is self-luminescent and has a wide angle of field, that the thinness, and the lightness can be realized without a light source. Further, the response speed is fast, and it is suitable for display of a moving image. Thus, more sophistication and high added value can be realized by applying a display device using such a light-emitting element.

What is claimed is:

1. A display device comprising:

a substrate having a minor surface; and a display means over the substrate having a minor surface; and an image sensing means over the substrate having a mirror surface, wherein a plurality of light-emitting elements each having a luminescent material sandwiched between a pair of electrodes having light-transmittivity are arranged in the display means, and wherein a plurality of photovoltaic conversion elements are arranged in the image sensing means.

2. A display device comprising:

a substrate having a reflecting surface;

a display means over the substrate having a reflecting surface; and an image sensing means over the substrate having a reflecting surface, wherein a plurality of light-emitting elements each having a luminescent material sandwiched between a pair of electrodes having light-transmittivity are arranged in the display means, wherein a plurality of photovoltaic conversion elements are arranged in the image sensing means, and wherein the display means and the image sensing means are secured to the substrate with a barrier film therebetween.

3. A display device according to claim 1, wherein the display device is used as a side-view mirror for vehicle.

4. A display device according to claim 2, wherein the display device is used as a side-view mirror for vehicle.

5. A display device according to claim 1, wherein the display device is used as a rearview mirror for vehicle.

6. A display device according to claim 2, wherein the display device is used as a rearview mirror for vehicle.

7. A display device according to claim 1, wherein the display device is applied to an electronic device selected from the group consisting of a portable terminal and a PDA.

8. A display device according to claim 2, wherein the display device is applied to an electronic device selected from the group consisting of a portable terminal and a PDA.

9. A display device according to claim 1, wherein an insulating film is formed over the plurality of light-emitting elements and the photovoltaic conversion element is formed over the insulating film.

10. A display device according to claim 2, wherein an insulating film is formed over the plurality of light-emitting elements and the photovoltaic conversion element is formed over the insulating film.

11. A display device comprising:

a substrate;

a reflection coating film over the substrate;

a first insulating film over the reflection coating film;

a first light-transmissive electrode and a second light-transmissive electrode over the first light-transmissive electrode with a luminescent material sandwiched therebetween, over the first insulating film;

a second insulating film over the second light-transmissive electrode; and a photovoltaic conversion element over the second insulating film.

12. A display device comprising:

a substrate;

a reflection coating film over the substrate;

a first insulating film over the reflection coating film;

a transistor formed over the first insulating film;

a first light-transmissive electrode electrically connected to the transistor, and a second light-transmissive electrode over the first light-transmissive electrode with a luminescent material sandwiched therebetween, over the first insulating film;

a second insulating film over the second light-transmissive electrode; and a photovoltaic conversion element over the second insulating film.

13. A display device according to claim 11, wherein the display device is used as a side-view mirror for vehicle.

14. A display device according to claim 12, wherein the display device is used as a side-view mirror for vehicle.

15. A display device according to claim 11, wherein the display device is used as a rearview mirror for vehicle.

16. A display device according to claim 12, wherein the display device is used as a rearview mirror for vehicle.

17. A display device according to claim 11, wherein the display device is applied to an electronic device selected from the group consisting of a portable terminal and a PDA.

18. A display device according to claim 12, wherein the display device is applied to an electronic device selected from the group consisting of a portable terminal and a PDA.

19. A display device according to claim 11, wherein the photovoltaic conversion element includes a p-layer, i-layer, and an n-layer, wherein the p-layer is connected to an electrode and the n-layer is connected to an electrode.

20. A display device according to claim 12, wherein the photovoltaic conversion element includes a p-layer, i-layer, and an n-layer, wherein the p-layer is connected to an electrode and the n-layer is connected to an electrode.

21. A display device according to claim 11, wherein the reflection coating film is at least one selected from the group consisting of aluminum, silver, gold, copper, cadmium, nickel, platinum, rhodium, tungsten, titanium, tantalum, molybdenum, chrome, neodymium, iron, nickel, cobalt, zirconium, zinc, ruthenium, palladium, osmium, iridium, and tin.

22. A display device according to claim 12, wherein the reflection coating film is at least one selected from the group consisting of aluminum, silver, gold, copper, cadmium, nickel, platinum, rhodium, tungsten, titanium, tantalum, molybdenum, chrome, neodymium, iron, nickel, cobalt, zirconium, zinc, ruthenium, palladium, osmium, iridium, and tin.

* * * * *